United States Patent [19]

Peterson et al.

[11] Patent Number: 4,879,857

[45] Date of Patent: Nov. 14, 1989

[54] RESILIENT LEVELER AND SHOCK ABSORBER FOR SPORT FLOOR

[75] Inventors: David L. Peterson; Michael J. Peterson, both of Oakdale, Minn.

[73] Assignee: Sport Floor Design, Inc., Maplewood, Minn.

[21] Appl. No.: 206,977

[22] Filed: Jun. 10, 1988

Related U.S. Application Data

[63] Continuation of Ser. No. 873,999, Jun. 13, 1985, abandoned.

[51] Int. Cl.[4] ..... E04F 15/22

[52] U.S. Cl. ..... 52/403; 52/479; 52/480; 248/632; 248/634

[58] Field of Search ..... 52/403, 479, 480; 248/615, 634, 188.9, 188.8, 632, 618

[56] References Cited

U.S. PATENT DOCUMENTS

| | | | |
|---|---|---|---|
| Re. 26,239 | 7/1967 | Rockabrand et al. . | |
| 216,656 | 2/1870 | Horwich . | |
| 498,344 | 5/1893 | Williams . | |
| 638,997 | 12/1899 | Stock | 248/188.9 |
| 863,054 | 8/1907 | Dickerson . | |
| 895,215 | 8/1908 | Vogel | 248/188.9 |
| 1,137,138 | 4/1915 | Heron | 248/188.9 |
| 1,356,797 | 10/1920 | Stock | 248/188.9 |
| 1,356,798 | 10/1920 | Stock | 248/188.9 |
| 1,477,331 | 12/1923 | Ely | 248/615 |
| 1,734,727 | 11/1929 | Herold | 248/188.9 |
| 1,757,518 | 5/1930 | Ehmer | 248/615 |
| 1,789,576 | 1/1931 | Bowman | 52/403 |
| 2,167,696 | 8/1939 | Tetzman . | |
| 2,569,709 | 10/1951 | Elmendorf . | |
| 2,862,255 | 12/1958 | Nelson . | |
| 2,893,665 | 7/1959 | Paulsen | 248/615 |
| 3,107,377 | 10/1963 | Nathan . | |
| 3,273,296 | 9/1966 | Soulon | 52/288 |
| 3,288,405 | 11/1966 | Johnson | 248/615 |
| 3,337,167 | 8/1967 | Johnson | 248/615 |
| 3,368,806 | 2/1968 | Szonn . | |
| 3,417,950 | 12/1968 | Johnson | 248/615 |
| 3,601,345 | 8/1971 | Johnson | 248/615 |
| 3,604,173 | 9/1971 | Dahlborg . | |
| 4,302,552 | 11/1981 | Hongu et al. | 248/634 |
| 4,589,243 | 5/1986 | Abendroth | 52/403 |

FOREIGN PATENT DOCUMENTS

| | | | |
|---|---|---|---|
| 1907190 | 8/1970 | Fed. Rep. of Germany | 52/480 |
| 4073 | of 1888 | United Kingdom | 248/188.9 |
| 18992 | of 1909 | United Kingdom | 248/188.9 |
| 23589 | of 1913 | United Kingdom | 248/615 |
| 242924 | 11/1925 | United Kingdom | 248/188.9 |
| 565012 | 10/1958 | United Kingdom | 248/188.9 |

*Primary Examiner*—Michael Safavi

*Attorney, Agent, or Firm*—Merchant, Gould, Smith, Edell, Welter & Schmidt

[57] ABSTRACT

For a sports or athletic floor having an upper playing surface on a subfloor over a solid base such as a cement slab or the like, the subfloor is supported only by a series of individual resilient shock-absorbing members uniformly located between the subfloor and the solid base to provide the requisite air space under the subfloor and to provide shock-absorbing and levelling of the sports floor.

14 Claims, 2 Drawing Sheets

RESILIENT LEVELER AND SHOCK ABSORBER FOR SPORT FLOOR

This is a continuation of Application Ser. No. 873,999, filed June 13, 1985 now abandoned.

FIELD OF THE INVENTION

This invention is directed for use with sports or athletic floors such as basketball courts, racquetball courts, aerobic dance floors and the like. More specifically, this invention is directed toward providing sports floors of this nature with the required degree of elasticity and at the same time providing level floors with the floor support being uniform virtually throughout its breadth.

BACKGROUND OF THE INVENTION

Sports floors or athletic floors have certain requirements above and beyond floors used for nonathletic purposes. As with most floors, there must be support on the underside with some air space if the floor is resting on a solid base such as a cement slab. But, unlike other types of floors, athletic floors must have some degree of elasticity under load, and yet be quite firmly supported. Further, the floor must be uniformly supported throughout its breadth so that there are no dead spots which could affect the play of the game, such as the way a basketball or racquetball or handball bounces, or the user's reaction, such as on a person doing aerobic dancing. In addition, of course, the floors must be level so that the ball will bounce true and accurate on any spot on the floor. For example, in U.S. Pat. Re. No. 26,239 by Rockabrand, et al. somewhat resilient floor pads in strips are located under the elongated sleepers or joists or beams which hold the floor spaced above a rigid cement slab base. A basketball being dribbled or a handball rebounding on the floor or a player running or jumping may hit the dead spots in the unsupported areas between the sleepers or joists and may react somewhat differently than when striking the floor immediately above one of the supporting joists. In addition, dead spots can develop because of unevenness of or depressions in the top surface of the cement slab. Although when the slab is laid it is checked to make sure that it has a level top surface, while it sets some undetected depressions may develop in spots anywhere throughout the breadth of the slab. At these depression areas the joists or sleepers, even with a floor pad such as Rockabrand's , would not rest firmly against the cement slab so that another type of dead spot can result and a ball impacting the floor or an individual running or jumping on the floor may feel that dead spot.

SUMMARY OF THE INVENTION

In general, the athletic floor with which this invention is used is made in a conventional fashion. The upper playing surface may be and generally is made of tongued and grooved strips of suitable wood, such as maple, which are matched and laid out over the breadth of the floor. Alternatively, the playing surface may be suitably laid artificial turf. Under this playing surface there is usually a subflooring and both are supported over a solid base such as a cement slab. In the instant invention a number of spaced-apart individual nodule-like resilient shock-absorbing members are located under the subflooring and totally support the subflooring and the playing surface on the solid base. No sleepers or joists or beams are used for support. These shock absorbers provide the necessary gap between the cement base and the subflooring for air space and absorb the impact of balls bouncing or persons running or jumping on the floor. The shock-absorbers will partially compress from the weight of the subflooring and the playing surface so that the floor will be level and evenly supported even should there be some depressions in the cement base. The shock absorbers are spread out uniformly so that the weights and forces which bear downward on the floor are spread over a wide support area and there is no feeling or reaction of a dead spot. As a further feature, the shock absorber elements are made of materials and constructed such that their resistance to the applied force increases with the amount of the load. These and other features and advantages of the invention will become apparent from the following detailed description with reference to the accompanying drawings.

DETAILED DESCRIPTION OF THE PREFERRED EMBODIMENTS

The instant invention is directed for use with athletic floors or sports floors. Although the detailed description of the invention will be made with respect to a hardwood floor such as used in a basketball court or racquetball court or the like, it should be understood that the advantages and features of the invention may make it suitable for use for supporting an artificial turf playing surface.

Figure 1:
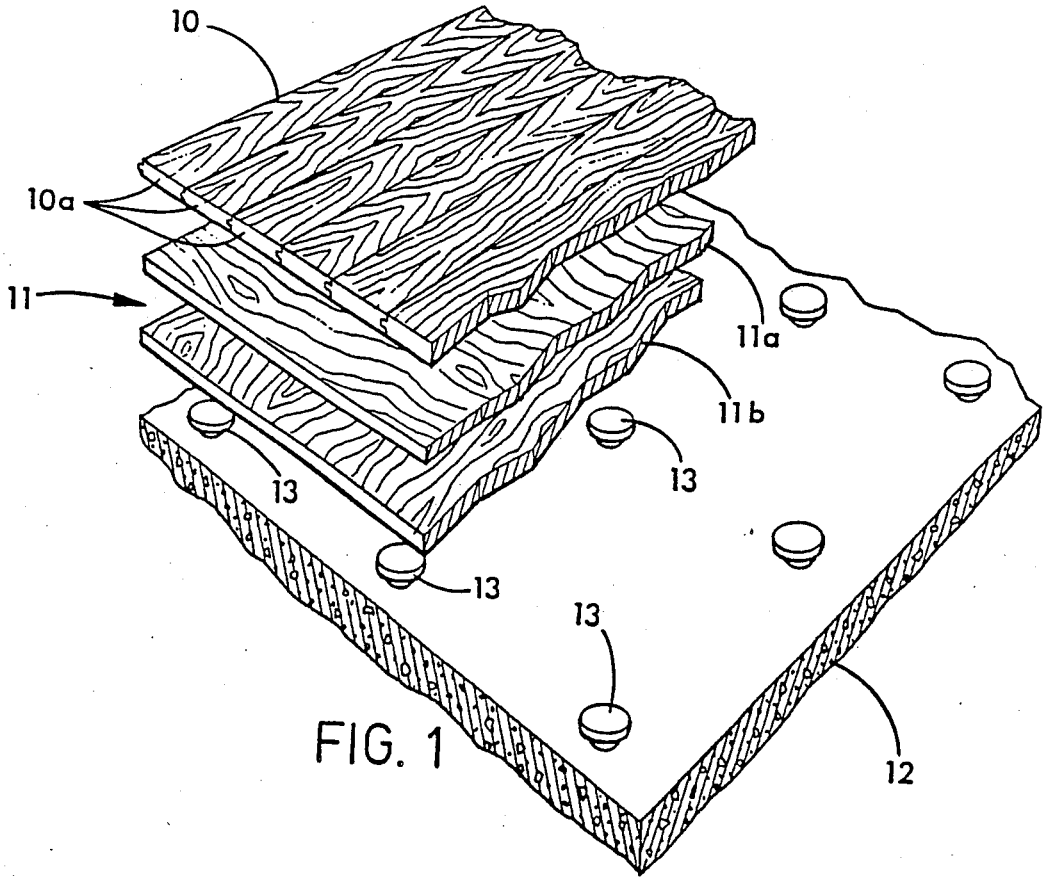
FIG. 1 is a blown-apart, broken isometric view showing an athletic floor utilizing a preferred embodiment of the invention.
Figure 2:
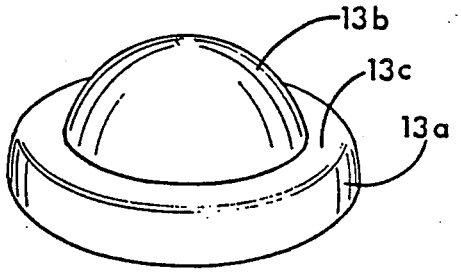
FIG. 2 is an isometric view of a preferred form of the instant invention.

A conventional floor of a basketball court has a playing surface 10 made out of tongued and grooved strips 10*a* of wood such as maple. Resting directly under and in contact with the underside of the playing surface 10 is subflooring 11 which typically may be made of two sheets 11*a* and 11*b* of ½" CDX plywood. A cement slab 12 provides a rigid support base for the playing floor and the subflooring. Located between the base 12 and the subflooring 11 are a multiplicity of individual resilient spaced-apart shock-absorber elements 13. The elements 13 are spread out uniformly at equal center-to-center distances throughout the breadth of the floor. Typically, and with no limitation thereto intended for a gymnasium floor, the elements 13 may be spaced at nine-inch center-to-center intervals and for an aerobic dance floor, at one-foot center-to-center intervals. As illustrated in FIG. 2, the shock-absorbers 13 are nodule-shaped having a frusto-spherical portion 13*a* and a spherical segment or dome portion 13*b* centrally located on one of the flat surfaces of portion 13*a*. The diameter of the base area of the dome 13*b* is less than the diameter of the flat surface area of the frusto-spherical portion 13*a* upon which it rests forming a rim area 13*c* between the outer peripheries of the two portions. Preferably member 13 is molded as a single homogeneous unit made out of a suitable polyurethane material having the same durometer throughout. Alternatively, one of the portions 13*a* or 13*b* may be of a material having different durometer from the other. The shock-absorber members 13 may be oriented with the dome portion 13b resting on the rigid base 12, as illustrated in FIG. 1, or may be reversed. Preferably, the durometer of the material should be in the range of 40–80 and it has been found experimentally that the best all-around benefits are derived using material having a durometer in the range of about 50–70. For each application some initial testing may have to be made to select the suitable durometer. In any event, it is clear that the members 13 should not be so soft that they will virtually flatten out from the weight and the forces that are applied, nor should they be so hard as to provide virtually no elastic shock abosorbing effect at the loads or forces which are normally encountered.

Figure 3:
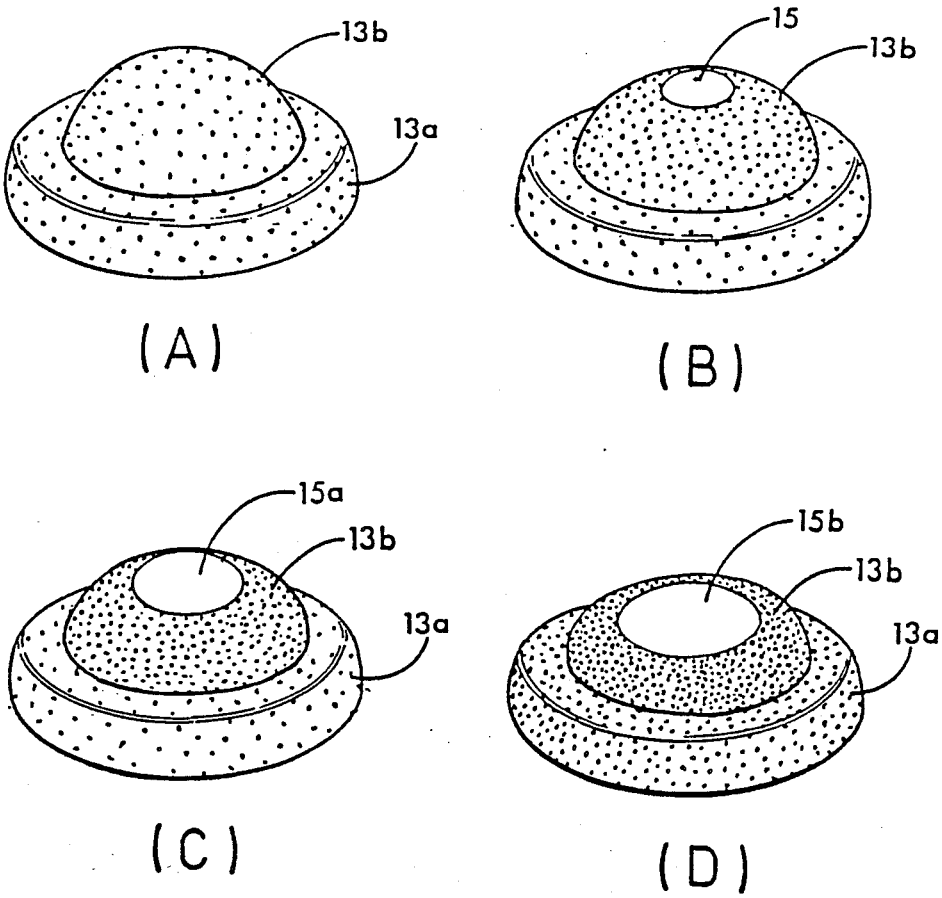
FIGS. 3A–D diagramatically illustrate how the device of this invention reacts as the applied pressure or force increases.
Figure 4:
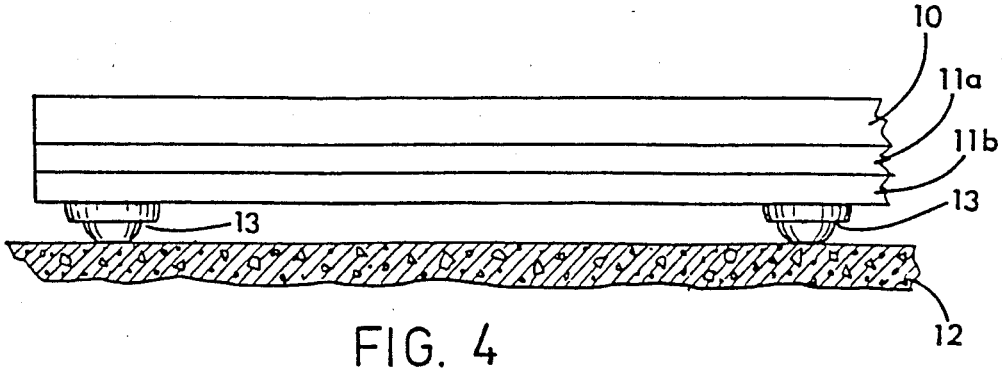
FIG. 4 is an end elevational view showing a floor utilizing a preferred embodiment of the invention.

FIGS. 3A–D shown somewhat diagrammatically the manner in which it appears that members 13 function. FIG. 3A represents the shock-absorber member 13 in its free, uncompressed and unpressured condition. FIG. 3B shows a flattened area 15 at the top of the dome portion 13*b* which represents the condition where the members 13 are in place under the flooring and are supporting only the weight of the flooring above. All of the individual members 13 located throughout the breadth of the floor bear some of the weight of the flooring so that all would be somewhat depressed and flattened at the top of the dome portion as illustrated in FIG. 3B. The dots within the separate portions of members 13 are utilized to illustrate what has been observed of the manner of the response of members 13 to pressures applied from the floor above. With just the weight of the flooring alone only the dome section 13b appears to compress and the frusto-spherical portion 13a appears unchanged. The excess dots in FIG. 3B as compared to FIG. 3A illustrate what appears to be an increase in the density of the dome portion 13*b* by the weight of the floor alone. FIG. 3C illustrates a wider flattened portion 15*a* of the dome section 13*b* as the force or pressure from above increases. Lastly, FIG. 3D illustrates the condition where still greater pressure is applied so that section 13*a* now appears to increase in density to take up some of the increased load and the top of the dome portion 13*b* is still further flattened at 15*b*.

Since initially all of the members 13 are supporting some of the weight of the flooring, if there are depressions in the cement base 12, no dead spots will be felt on the playing surface 10 because all of the members 13 will be providing some support between the floor and the cement base. This means also that any impact from above is absorbed by a large number of members 13 which are in the general area surrounding the point of impact. For example, it has been found that if a 180 pound person where to made an average jump on an aerobic floor, the force would be absorbed over approximately a four-foot diameter circular area centered at the point of impact and be absorbed by approximately 16 shocks 13 which are spaced under the floor at one-foot intervals.

In a typical installation for an aerobic dance floor, the dimension of portion 13*a* is the general equivalent of about a 7/16 inch high slice of a 1½ inch diameter sphere with the flat surface through the center of the sphere and the dimension of portion 13*b* is the general equivalent of about a 5/16 inch high portion of a one inch diameter sphere.

As compared to the prior art such as illustrated by the Rockabrand, et al. U.S. Pat. Re. 26,239, in the instant invention there are no rigid support members between the subfloor and the concrete base. Rockabrand utilizes beams or sleepers under the subfloors so that any impact or pressure applied to the playing surface is applied linearally along the rigid sleeper beams. In the present invention the pressure or impact applied from the playing surface is distributed evenly over the circular area surrounding the point of impact or force. Also, the need for special milling of the sleepers or beams is eliminated thereby reducing the overall cost of the floor assembly. In the prior art the sleeper beams must be placed precisely and aligned with one another between the subfloor and the concrete base. In the instant invention all that need be done is to place the shock absorber elements at predetermined locations on the cement base and then set the subfloor over the shocks. By uniformly spreading the elastic shock absorbers and eliminating the rigid beams, the entire floor is uniformly supported and there is no feeling of any dead spots.

Another feature is that because the floor is uniformly supported by the shock absorber elements alone, the flexing of the flooring is such to create a breathing effect by causing relatively large amount of air movement in the air space between the subflooring and the concrete base.

We claim:

1. A floor construction for providing resilient support, comprising:

(a) a continuous playing surface;

(b) a continuous subflooring in continuous contact with and directly supporting said playing surface;

(c) a rigid solid base beneath said subflooring; and (d) a plurality of resilient, shock-absorbing members, said shock-absorbing members being uniformly spaced apart and being located between said subflooring and said base so as to support said subflooring and playing surface, each of said shock-absorbing members including a first base portion in contact with said subflooring, said first base portion being frusto-spherical in shape, and a second portion having a domed surface in contact with said base said second portion being semi-spherical in shape, said first base portion having a greater diameter than said second portion so as to form an annular rim, wherein said domed surface becomes increasingly flattened proximate the point of contact of said domed surface with said base in response to increasing force upon said playing surface

2. The floor construction according to claim 1, wherein said domed surface of said second portion of said shock-absorbing members is slightly flattened proximate the point of contact of said domed surface with said base due to the weight of said playing surface and said subflooring.

3. The floor construction according to claim 2, wherein said domed surface of said second portion of said shock-absorbing members becomes increasingly flattened proximate the point of contact of said domed surface with said base in response to increased force upon said playing surface and said shock-absorbing members return to a substantially convex configuration in response to removal of said force.

4. The floor construction according to claim 1, wherein said base portion is approximately one and one-half inches in diameter.

5. The floor construction according to claim 1, wherein said shock-absorbing members are uniformly spaced and are approximately twelve inches apart.

6. The floor construction according to claim 1, wherein said shock-absorbing members are uniformly spaced and are approximately nine inches apart.

7. The floor construction according to claim 1, wherein said shock-absorbing members are of unitary integral construction and are made of an elastomeric material.

8. The floor construction according to claim 6, wherein said shock-absorbing members are made of polyurethane.

9. The floor construction to claim 4, wherein said second, semi-spherical portion has a diameter of approximately one inch at its widest point proximate said base portion.

10. The floor construction according to claim 9, wherein said base portion is approximately 5/16 inches high and said second portion is approximately 7/16 inches high.

11. A shock absorbing member for providing resilient support to a floor having an underlying support structure, said shock-absorbing member supporting a playing surface structure of said floor, said shock-absorbing member comprising a base portion of resilient material which is frusto-sperical in shape and has a diameter of approximately one and one-half inch, said base portion having a flat surface; and a nodule portion of resilient material proximate said base portion, said nodule portion having a domed surface opposite said flat surface, said domed surface being in contact with said support structure, said nodule portion being compressible between a first, substantially convex configuration wherein said domed surface is slightly flattened due to the weight of said playing surface structure, and a second configuration wherein said domed surface is substantially flattened when significant force is applied to said playing surface structure, said domed portion becoming increasingly flattened in response to increased force upon said floor, said shock-absorbing member returning to said first configuration in response to removal of said force.

12. The floor construction according to claim 11, where said nodule portion has a diameter of approximately one inch at its widest point proximate said base portion.

13. The floor construction according to claim 12, wherein said base portion is approximately 5/16 inches high and said nodule portion is approximately 7/16 inches high.

14. A shock-absorbing member for providing resilient support to a floor having an underlying support structure, said shock-absorbing member supporting a playing surface structure of said floor, said shock-absorbing member comprising a base portion of resilient material which has a flat surface; and a nodule portion of resilient material proximate said base portion, said nodule portion having a domed surface opposite said flat surface, said domed surface being in contact with said support structure, said nodule portion being compressible between a first, substantially convex configuration wherein said domed surface is slightly flattened due to the weight of said playing surface structure, and a second configuration wherein said domed surface is substantially flattened when significant force is applied to said playing surface structure, said domed portion becoming increasingly flattened in response to increased force upon said floor, said shock-absorbing member returning to said first configuration in response to removal of said force, wherein the durometer of the base portion differs from the durometer of the nodule portion.

* * * * *